US005387044A

United States Patent [19]

Accardo

[11] Patent Number: 5,387,044

[45] Date of Patent: Feb. 7, 1995

[54] SCREEN FILLER APPLICATOR FOR THE SCREEN PRINTING INDUSTRY

[76] Inventor: Thomas A. Accardo, 109 Cambridge St., Winchester, Mass. 01890

[21] Appl. No.: 166,888

[22] Filed: Dec. 15, 1993

[51] Int. Cl.[6] ..... B43K 8/00; B41L 13/00

[52] U.S. Cl. ..... 401/5; 101/114; 401/139; 401/261; 401/266

[58] Field of Search ..... 401/139, 266, 5, 261, 401/263; 101/114

[56] References Cited

U.S. PATENT DOCUMENTS

| | | | |
|---|---|---|---|
| 403,625 | 5/1889 | Thompson | 401/139 |
| 1,376,134 | 4/1921 | Bearden | 401/139 |
| 2,066,792 | 1/1937 | McLeod | 401/266 |
| 2,376,243 | 5/1945 | Fraser | 401/5 X |
| 2,559,553 | 7/1951 | Wolff | 401/266 X |
| 2,716,251 | 8/1955 | Pearce | 401/139 |
| 2,930,063 | 3/1960 | Stull | 401/266 X |
| 3,334,792 | 8/1967 | De Vries et al. | 401/5 X |
| 3,459,482 | 8/1969 | Fears | 401/266 X |
| 3,972,631 | 8/1976 | Huber | 401/261 |
| 4,783,185 | 11/1988 | Erismann et al. . | |

FOREIGN PATENT DOCUMENTS

| | | | |
|---|---|---|---|
| 69526 | 4/1943 | Norway | 401/139 |

*Primary Examiner*—Steven A. Bratlie

[57] ABSTRACT

A liquid coating applicator employs a disposable and replaceable squeegee blade adapted to permit the simultaneous dispensing and spreading of controlled amounts of screen filler onto screen printing stencil surfaces. The squeegee blade is removably attached to the dispensing end of the applicator to immediately contact and spread the dispensed liquid. The applicator threadingly attaches to a reservoir of liquid screen filler having resiliently flexible walls and which is refillable.

9 Claims, 3 Drawing Sheets

SCREEN FILLER APPLICATOR FOR THE SCREEN PRINTING INDUSTRY

BACKGROUND OF THE INVENTION

Screen printing stencils in use throughout the screen printing industry often require treatment with screen filler (or sealer) coatings prior to their use in actual printing, to prevent the occurrence of unwanted marks within the indicia to be applied, caused by imperfections, such as pinholes arising in the stencil media itself. Such treatments with screen fillers are performed by spreading or brushing these liquid coatings onto the screen printing stencil surface by means of brushes or flat card-like object used as a squeegee. When the coating is dry, the resultant treated screen printing stencil is free of pinholes and other such imperfections and ready for use.

It would be economically advantageous within the screen printing industry to use a screen filler applicator that permits the simultaneous dispensing and spreading of screen filler coatings in a single continuous application from a single container/applicator. It is one purpose of the invention to provide a screen filler applicator that permits the screen filling treatment to be carried out in a single application process. Another purpose of the invention is to provide replaceable and inexpensive cardboard squeegee blades. A further purpose of the invention is to allow the use of a refillable fluid reservoir for the screen filler material at substantial savings in the cost of containers.

SUMMARY OF THE INVENTION

The invention comprises a multi-functional screen filler applicator that dispenses a controlled amount of material while simultaneously spreading and smoothing the material out onto the screen printing stencil surface. A squeegee member is removably attached to the dispensing end of the applicator and is discarded and replaced after use. The applicator is threadingly attached to the end of a fluid reservoir which is refillable and reusable.

Figure 1:
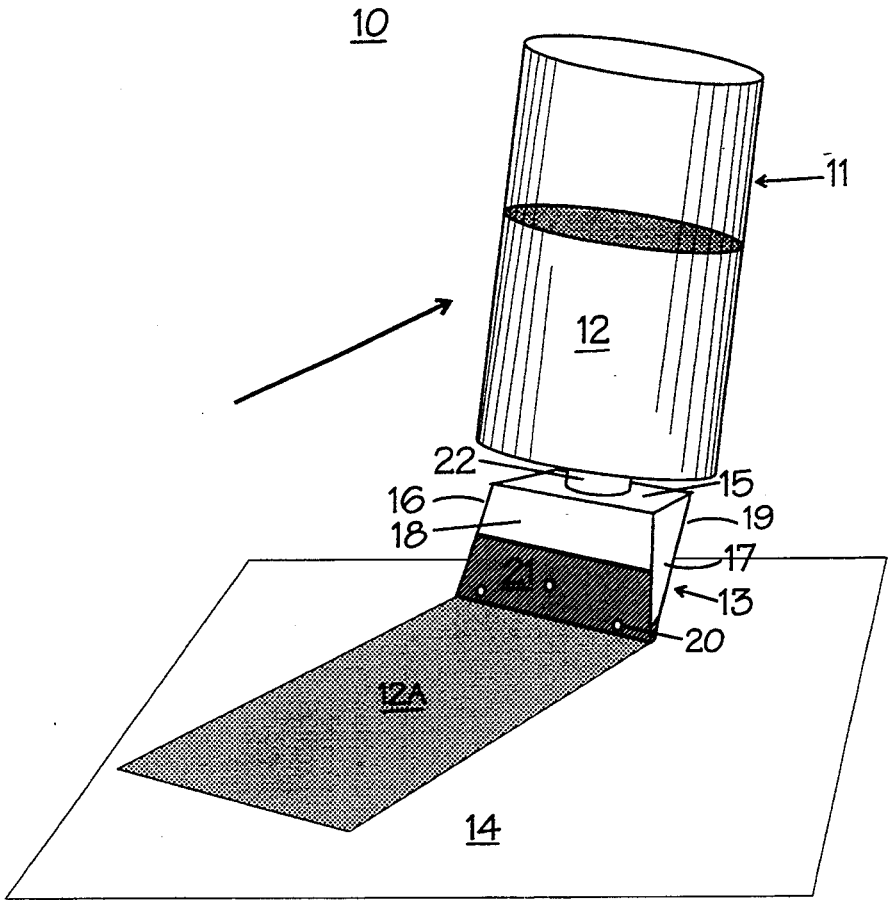
FIG. 1 is a top perspective view of the screen filler applicator according to the invention.

The screen filler applicator 10, shown in FIG. 1, includes a container 11 of liquid screen filler 12. The container is attached to the neck 22 of a plastic dispenser 13 that applies the screen filler smoothly and continuously. The dispenser is defined by a pair of opposing triangular sides 16, 17 closed by a top 15, a rectangular front 18 and a rectangular back 19. To provide a uniform and controllable coating of screen filler, a disposable snap-on squeegee blade 21 is attached to the front 18 by means of three upstanding pins 20 that are integrally formed with the plastic material used to fabricate the dispenser 13. To apply the screen filler coating, the applicator 10 is manually engaged and transposed in the direction of the indicating arrow in a continuous motion, with the dispenser 13 held at a predetermined angle relative to the plane of the stencil surface 14 such that the squeegee blade 21 is held in abutment with the stencil surface to provide sufficient smoothing force to the screen filler 12A.

When the squeegee blade 21 is no longer capable of smoothly applying the screen filler, it is removed from the pins 20 and discarded.

Figure 2:
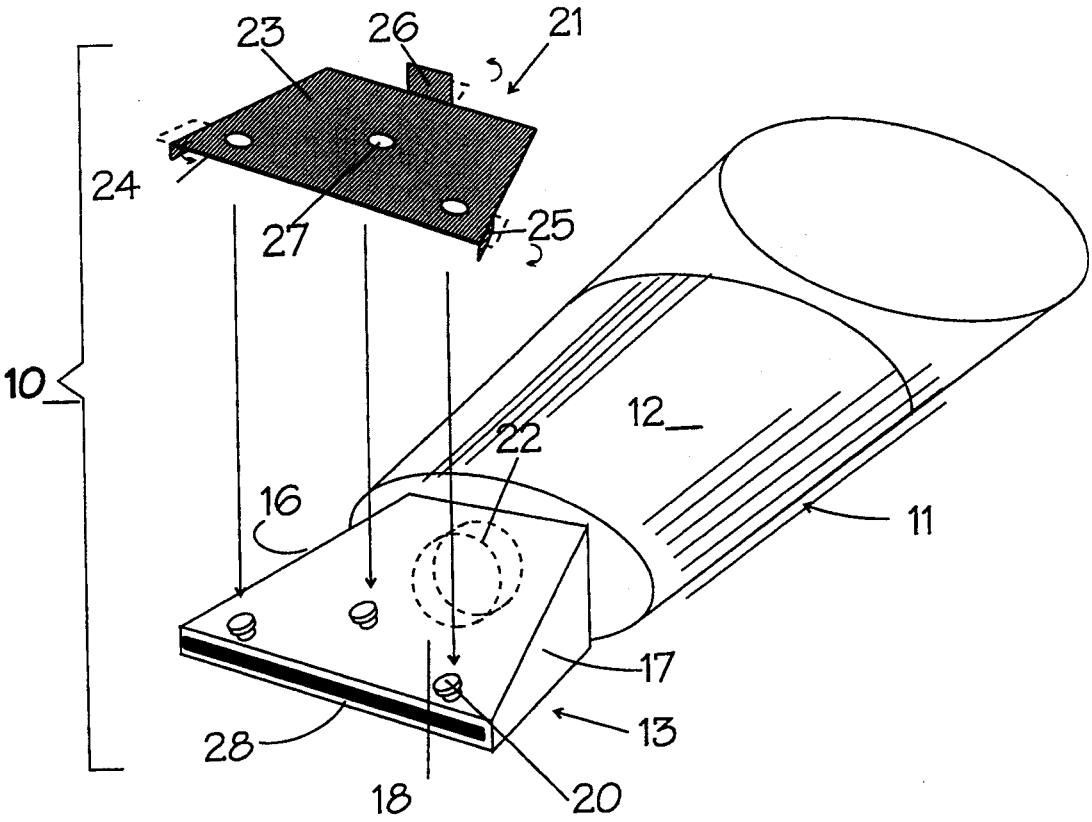
FIG. 2 is a top perspective view of the applicator of FIG. 1 with the disposable squeegee blade in isometric projection.

As shown in FIG. 2, a fresh squeegee blade 21 fabricated from a cardboard material is removably attached to the dispenser 13 by positioning the squeegee blade on the front 18 and capturing the upstanding pins 20 within the corresponding apertures 27 formed within the cardboard material 23. A pair of tabs as depicted in the phantom are formed within the cardboard blade 21 and are pressed downward to form the squeegee blade sides 24 and 25 which engage the corresponding triangular sides 16, 17 of the dispenser 13, and serve the purpose of confining any dispensed material to areas of the stencil surface directly in front of and in the path of the squeegee blade scraping edge 30. A tab 26 is formed on the back edge of the cardboard blade 21 and is pressed upward to provide an easy means for grasping and removing the squeegee blade. With the squeegee blade 21 attached to the dispenser 13 to form the final applicator 10, the liquid screen filler 12 within the container 11 then travels downward from the container through the neck 22 of the dispenser 13 and exits through the rectangular aperture 28 formed at the bottom of the rectangular front 18.

Figure 3:
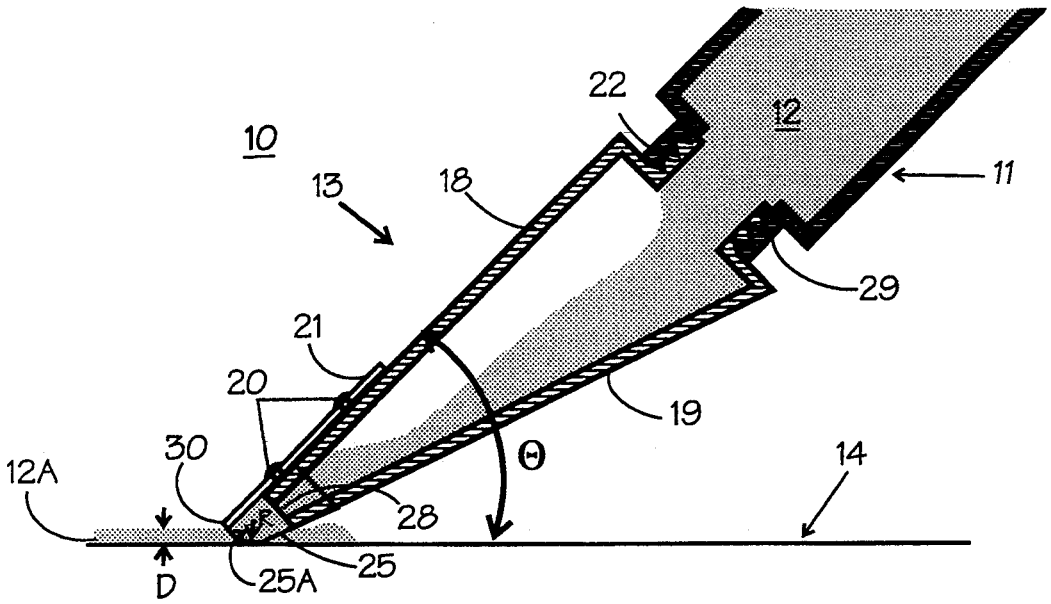
FIG. 3 is an enlarged view in partial section of the applicator in FIG. 1.

As best seen by referring to FIG. 3, the applicator 10 is arranged at the desired application angle 0 to control the deposit thickness of screen filler 12. The container 11 is removably attached to the neck 22 of the dispenser 13 by means of the threaded end 29, as indicated. This assures the transfer of the screen filler from the container to the dispenser without leaking. The screen filler transfers out from the interior through the rectangular aperture 28 where it becomes contacted by the scraping end 30 and sides 24 and 25 of the squeegee blade 21 which is held tightly against the front 18 by means of the upstanding pins 20 which prevent the squeegee blade from pulling away from the dispenser as the smoothing pressure is applied to the scraping end of the squeegee blade. The forward edges of the squeegee sides 24, 25 are shaped to a radius of curvature R, as indicated at 25A, thus permitting a continuous range of application angles $\Theta$ and corresponding deposit thicknesses D of screen filler 12A. As described earlier, the snap-on squeegee blades 21 are fabricated from inexpensive cardboard material and are supplied in bulk quantities along with the applicator at minimum cost. The dispenser 13 is integrally cast from a thermoset or thermoplastic material and can be used indefinitely without excessive wear or damage. The container 11 can be continuously refilled from a large sized storage container of screen filler.

Accordingly, a screen filler applicator has herein been described that offers substantial economic advantages to the screen printing industry. The provision of the shaped dispenser allows precisely dispensed quantities of screen filler to be automatically and conveniently controlled to a resultant location having a uniform and controllable deposit thickness.

I claim:

1. A screen filler applicator comprising:

a dispenser defining a liquid receiving end at a top part thereof and a liquid dispensing opening at the bottom part thereof;

an upstanding pin extending from an exterior surface of said dispenser for attaching a squeegee blade, said squeegee blade having radial-shaped sides and an aperture for capturing said upstanding pin and holding said squeegee blade against said exterior surface whereby said liquid exits from said liquid dispensing opening and is trapped between an edge of said squeegee blade and a substrate surface.

2. The applicator of claim 1 wherein said liquid receiving end comprises a threaded extension.

3. The applicator of claim 1 wherein said liquid dispensing opening comprises a rectangular aperture.

4. The applicator of claim 1 wherein said exterior surface defines a tapered front part.

5. The applicator of claim 1 wherein said dispenser includes a tapered back part.

6. The applicator of claim 1 wherein said dispenser is formed as a unitary enclosure.

7. The applicator of claim 1 wherein said squeegee blade has downwardly folded sidewalls for confining dispensed material.

8. The applicator of claim 1 wherein said squeegee blade includes an upwardly folded tab to assist removal of said squeegee blade from said dispenser.

9. The applicator of claim 1 wherein said squeegee blade is selected from the group of materials consisting of cardboard or fiber.

* * * * *